US009050793B2

(12) United States Patent
Chung et al.

(10) Patent No.: US 9,050,793 B2
(45) Date of Patent: Jun. 9, 2015

(54) INKJET PRINTING DEVICE AND METHOD OF DRIVING THE SAME

(75) Inventors: Jae-woo Chung, Yongin-si (KR); Young-ki Hong, Anyang-si (KR); Sung-gyu Kang, Suwon-si (KR)

(73) Assignee: SAMSUNG ELECTRONICS CO., LTD, Gyeonggi-Do (KR)

( * ) Notice: Subject to any disclaimer, the term of this patent is extended or adjusted under 35 U.S.C. 154(b) by 2049 days.

(21) Appl. No.: 12/107,133

(22) Filed: Apr. 22, 2008

(65) Prior Publication Data

US 2009/0096843 A1 Apr. 16, 2009

(30) Foreign Application Priority Data

Oct. 11, 2007 (KR) ..... 10-2007-0102582

(51) Int. Cl.

*B41J 2/045* (2006.01)
*B41J 2/06* (2006.01)
*B41J 2/14* (2006.01)

(52) U.S. Cl.

CPC .... *B41J 2/06* (2013.01); *B41J 2/14* (2013.01); *B41J 2/14233* (2013.01); *B41J 2202/09* (2013.01)

(58) Field of Classification Search

USPC ..... 347/52, 55, 71–76, 96, 125
See application file for complete search history.

(56) References Cited

U.S. PATENT DOCUMENTS 5,477,249 A * 12/1995 Hotomi ..... 347/48
7,387,372 B2 * 6/2008 Ishikawa et al. ..... 347/68
7,591,542 B2 * 9/2009 Sugahara ..... 347/68
7,780,275 B2 * 8/2010 Kusunoki ..... 347/77
7,794,063 B2 * 9/2010 Kobayashi et al. ..... 347/71
8,252,365 B2 * 8/2012 Tsukamoto ..... 427/100
2005/0190232 A1 * 9/2005 Lee et al. ..... 347/45
2006/0012646 A1 * 1/2006 Yasui ..... 347/71
2006/0092239 A1 * 5/2006 Sung et al. ..... 347/71
2006/0181581 A1 * 8/2006 Jung et al. ..... 347/68
2008/0122887 A1 * 5/2008 Ueno et al. ..... 347/10

FOREIGN PATENT DOCUMENTS

JP 10-166592 6/1998
JP 11-320890 11/1999
JP 2006-137060 6/2006
JP 2006-315232 11/2006
KR 1020060092397 8/2006

OTHER PUBLICATIONS

Korean Office Action dated Jul. 9, 2013 issued in KR Application No. 10-2007-0102582.

* cited by examiner

*Primary Examiner* — Daniel Petkovsek
(74) *Attorney, Agent, or Firm* — Harness, Dickey & Pierce, P.L.C.

(57) ABSTRACT

An inkjet printing device includes a flow path plate comprising a manifold to supply ink, a pressure chamber filled with the ink supplied from the manifold, and a nozzle via which the ink is ejected, a piezoelectric actuator which is disposed on a top surface of the flow path plate and includes a lower electrode, a piezoelectric layer, and an upper electrode that are stacked sequentially, a first electrostatic electrode to generate an electrostatic field, and a second electrostatic electrode which is disposed a predetermined distance apart from a bottom surface of the flow path plate to generate the electrostatic field between the first electrostatic electrode and the second electrostatic electrode.

7 Claims, 9 Drawing Sheets

INKJET PRINTING DEVICE AND METHOD OF DRIVING THE SAME

CROSS-REFERENCE TO RELATED APPLICATIONS

This application claims priority under 35 U.S.C. §119(a) from Korean Patent Application No. 10-2007-0102582, filed on Oct. 11, 2007, in the Korean Intellectual Property Office, the disclosure of which is incorporated herein in its entirety by reference.

BACKGROUND OF THE INVENTION

1. Field of the Invention

The present general inventive concept relates to an inkjet printing device, and more particularly, to an inkjet printing device to generate ultrafine droplets and a method of driving the same.

2. Description of the Related Art

Inkjet printing devices are used to eject fine droplets of ink onto desired positions of printing media in order to print predetermined images. The inkjet printing devices have lately been applied to a larger variety of fields, for example, flat panel displays (FPDs) such as liquid crystal displays (LCDs) and organic light emitting displays (OLED), flexible displays such as electronic papers (e-papers), printed electronics such as metal interconnection lines, and organic thin film transistors (OTFTs). Among process techniques for applying the inkjet printing devices to display devices or printed electronics, more attention must be paid to developing high-resolution ultrafine printing techniques.

Inkjet printing devices may be classified into piezoelectric inkjet printing devices and electrostatic inkjet printing devices depending on how the ink is ejected. Specifically, the piezoelectric inkjet printing devices eject ink by deforming a piezoelectric material, while the electrostatic inkjet printing devices eject ink using electrostatic force. Also, the electrostatic inkjet printing devices may operate based on the following two methods. First, ink droplets may be ejected using electrostatic induction. Second, charged pigments may be accumulated using electrostatic force and ink droplets may be then ejected.

In the case of a piezoelectric inkjet printing device, since ink is ejected by a drop on demand (DOD) technique, controlling printing operation and driving the inkjet printing device is easy. Also, the piezoelectric inkjet printing device generates ejecting energy by mechanically deforming a piezoelectric material and any type of ink may be used. However, the piezoelectric inkjet printing device can neither produce ultrafine droplets with a size of several picoliters or less nor allow ink droplets to exactly reach a desired position as compared with an electrostatic inkjet printing device. In contrast, the electrostatic inkjet printing device may produce ultrafine droplets, is easy to drive, and allows ink to be ejected in a desired direction, so that the electrostatic inkjet printing device is quite appropriate for a precise printing process. However, since forming separate ink flow paths in an electrostatic inkjet printing device using an electrostatic induction technique is difficult, ink cannot be easily ejected via a plurality of nozzles by DOD. Also, when charged pigments are accumulated due to an electrostatic force, necessitated by accumulating highly dense pigments, the ejection rate of ink droplets and the type of ink are limited.

SUMMARY OF THE INVENTION

The present general inventive concept provides an inkjet printing device to produce ultrafine droplets with high precise positioning and a method of driving the same.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an inkjet printing device including a flow path plate having a manifold to supply ink to the inkjet printing device, a pressure chamber filled with the ink supplied from the manifold, and a nozzle via which the ink is ejected, a piezoelectric actuator disposed on a top surface of the flow path plate and including a lower electrode, a piezoelectric layer, and an upper electrode that are stacked sequentially, a first electrostatic electrode to generate an electrostatic field, and a second electrostatic electrode disposed a predetermined distance apart from a bottom surface of the flow path plate to generate the electrostatic field between the first electrostatic electrode and the second electrostatic electrode. Recording media are disposed on the second electrostatic electrode.

The first electrostatic electrode may be disposed on the top surface of the flow path plate. The first electrostatic electrode may be separated from the lower electrode of the piezoelectric actuator or integrally formed with the lower electrode of the piezoelectric actuator.

The first electrostatic electrode may be disposed in the flow path plate.

The flow path plate may further include a restrictor to connect the manifold and the pressure chamber, and a damper to connect the pressure chamber and the nozzle. The first electrostatic electrode may be disposed on bottom surfaces of the pressure chamber, the restrictor, and the manifold. Alternatively, the first electrostatic electrode may be disposed on one of the bottom surfaces of the pressure chamber, the restrictor, and the manifold. Also, the first electrostatic electrode may be disposed on the inner wall of the nozzle.

The flow path plate on which the piezoelectric actuator is disposed may include a first substrate including the pressure chamber, a second substrate bonded to a bottom surface of the first substrate and including the manifold, the restrictor, and the damper, and a third substrate bonded to a bottom surface of the second substrate and including the nozzle. The first substrate may further include an ink inlet via which the ink is supplied to the manifold. The first, second, and third substrates may be formed of a material containing single crystalline silicon (Si).

The flow path plate on which the piezoelectric actuator is disposed may include a first substrate including the pressure chamber, and a second substrate bonded to a bottom surface of the first substrate and including the manifold, the restrictor, the damper, and the nozzle.

The foregoing and/or other aspects and utilities of the general inventive concept may also be achieved by providing a method of driving an inkjet printing device. The inkjet printing device including a flow path plate having a manifold to supply ink to the inkjet printing device, a pressure chamber filled with the ink supplied from the manifold, and a nozzle via which the ink is ejected, a piezoelectric actuator disposed on a top surface of the flow path plate and including a lower electrode, a piezoelectric layer, and an upper electrode that are stacked sequentially, a first electrostatic electrode disposed in or on the flow path plate to generate an electrostatic field, and a second electrostatic electrode disposed a predetermined distance apart from a bottom surface of the flow path plate to generate the electrostatic field between the first electrostatic electrode and the second electrostatic electrode. Recording media are disposed on the second electrostatic electrode. The method includes applying a predetermined bias voltage between the first and second electrostatic electrodes, and applying a predetermined piezoelectric driving pulse between the lower and upper electrodes of the piezoelectric actuator so as to eject the ink via the nozzle.

When the predetermined bias voltage is applied between the first and second electrostatic electrodes, the ink may protrude from the nozzle due to an electrostatic force generated between the first and second electrostatic electrodes. Also, while the predetermined bias is applied between the first and second electrostatic electrodes, a piezoelectric driving pulse may be applied between the lower and upper electrodes of the piezoelectric actuator so that the protruding ink can be ejected as a droplet type from the nozzle onto the recording media.

The foregoing and/or other aspects and utilities of the general inventive concept may also be achieved by providing a method of driving an inkjet printing device. The inkjet printing device includes a flow path plate having a manifold to supply ink to the inkjet printing device, a pressure chamber filled with the ink supplied from the manifold, and a nozzle via which the ink is ejected, a piezoelectric actuator disposed on a top surface of the flow path plate and including a lower electrode, a piezoelectric layer, and an upper electrode that are stacked sequentially, a first electrostatic electrode disposed in or on the flow path plate to generate an electrostatic field, and a second electrostatic electrode disposed a predetermined distance apart from a bottom surface of the flow path plate to generate the electrostatic field between the first electrostatic electrode and the second electrostatic electrode. Recording media are disposed on the second electrostatic electrode. The method includes applying a predetermined piezoelectric driving pulse between the lower and upper electrodes of the piezoelectric actuator, and applying a predetermined electrostatic driving pulse between the first and second electrostatic electrodes so as to eject the ink from the nozzle.

When the predetermined piezoelectric driving pulse is applied between the lower and upper electrodes of the piezoelectric actuator, the ink may protrude from the nozzle. While the ink protrudes from the nozzle, the predetermined electrostatic driving pulse may be applied between the first and second electrostatic electrodes so that the protruding ink can be ejected as a droplet type from the nozzle on a respective recording medium.

The foregoing and/or other aspects and utilities of the general inventive concept may also be achieved by providing an inkjet printing device including one or more nozzles, a piezoelectric unit to at least one of produce a meniscus of ink to protrude from the one or more nozzles and eject the protruding meniscus of the ink in a form of a droplet to reach a desired position of a recording medium, and an electrostatic unit to at least an other of produce the meniscus of ink to protrude from the one or more nozzles and eject the protruding meniscus of the ink in the form of the droplet to reach the desired position of the recording medium.

The foregoing and/or other aspects and utilities of the general inventive concept may also be achieved by providing an inkjet printing method including at least one of producing a meniscus of ink to protrude from the one or more nozzles and ejecting the protruding meniscus of the ink in a form of a droplet to reach a desired position of a recording medium by a piezoelectric unit, and at least an other of producing the meniscus of ink to protrude from the one or more nozzles and ejecting the protruding meniscus of the ink in the form of the droplet to reach the desired position of the recording medium by an electrostatic unit.

The foregoing and/or other aspects and utilities of the general inventive concept may also be achieved by providing a computer-readable recording medium having embodied thereon a computer program to execute a method, wherein the method includes at least one of producing a meniscus of ink to protrude from the one or more nozzles and ejecting the protruding meniscus of the ink in a form of a droplet to reach a desired position of a recording medium by a piezoelectric unit, and at least an other of producing the meniscus of ink to protrude from the one or more nozzles and ejecting the protruding meniscus of the ink in the form of the droplet to reach the desired position of the recording medium by an electrostatic unit.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
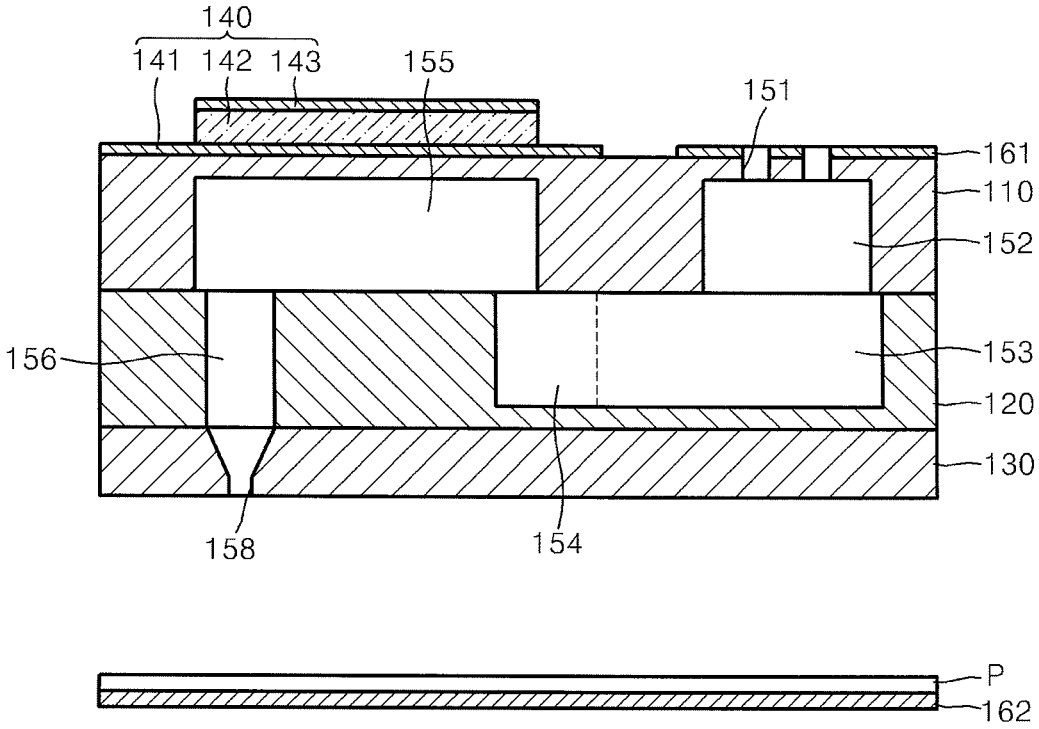
FIG. 1 is a cross-sectional view of an inkjet printing device according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures. In the drawings, thicknesses of components are exaggerated for clarity.

FIG. 1 is a cross-sectional view of an inkjet printing device according to an embodiment of the present general inventive concept.

Referring to FIG. 1, the inkjet printing device includes a flow path plate including an ink flow path, a piezoelectric actuator 140, which is disposed on the flow path plate, and first and second electrostatic electrodes 161 and 162, which are spaced apart from each other so as to generate an electrostatic field therebetween.

The flow path plate may include first, second, and third substrates 110, 120, and 130 that are bonded to one another. The first, second, and third substrates 110, 120, and 130 may be formed of, for example, a material containing single-crystalline silicon (Si). In this case, the flow path plate may be formed by bonding the first, second, and third substrates 110, 120, and 130 using a silicon direct bonding (SDB) process. The first substrate 110 may include a pressure chamber 155 that is filled with ink to be ejected. A portion of the first substrate 110, which forms a top wall of the pressure chamber 155, is deformed due to pressure created by the piezoelectric actuator 140 and functions as a vibrating plate to generate pressure waves in the pressure chamber 155. The second substrate 120 may include a manifold 153, which is used to supply ink to the pressure chamber 155, and a restrictor 154, which connects the manifold 153 and the pressure chamber 155. Also, the third substrate 130 may include a nozzle 158 via which ink is ejected. Meanwhile, the first substrate 110 may further include an ink inlet 152 via which ink is externally supplied to the manifold 153. At least one through hole 151 via which ink is externally supplied to the ink inlet 152 may be formed in a portion of the first substrate 110, which forms a top wall of the ink inlet 152. Also, the second substrate 120 may further include a damper 156 that connects the pressure chamber 155 and the nozzle 158. Although it is exemplarily described above that the flow path plate includes the three substrates 110, 120, and 130, the present general inventive concept is not limited thereto. For example, the flow path plate may include a first substrate (not illustrated), which includes a pressure chamber, and a second substrate (not illustrated), which includes a manifold, a restrictor, a damper, and a nozzle. Here, the first and second substrates may be formed of a material containing single-crystalline Si as described above. In this case, the first and second substrate may be bonded to each other by SDB to form the flow path plate. Meanwhile, according to the present general inventive concept, it is possible that the flow path plate may include four or more substrates. Furthermore, an ink flow path formed in the flow path plate may have various shapes.

The piezoelectric actuator 140 is disposed on a top surface of the flow path plate disposed on the pressure chamber 155. The piezoelectric actuator 140 is prepared so as to correspond to the pressure chamber 155. Due to the drive of the piezoelectric actuator 140, a portion of the first substrate 110 corresponding to a top surface of the pressure chamber 155 is deformed. The piezoelectric actuator 140 may include a lower electrode 141, a piezoelectric layer 142, and an upper electrode 143 that are stacked sequentially on the top surface of the flow path plate. The lower electrode 141 functions as a common electrode, while the upper electrode 143 functions as a driving electrode to apply a voltage to the piezoelectric layer 142. Also, the piezoelectric layer 142 is deformed by the applied voltage, so that the portion of the first substrate 110 corresponding to the top surface of the pressure chamber 155 is deformed in order to compress the pressure chamber 155. The piezoelectric layer 142 may be formed of a predetermined piezoelectric material, for example, a lead zirconate titanate (PZT) ceramic material.

Figure 4:
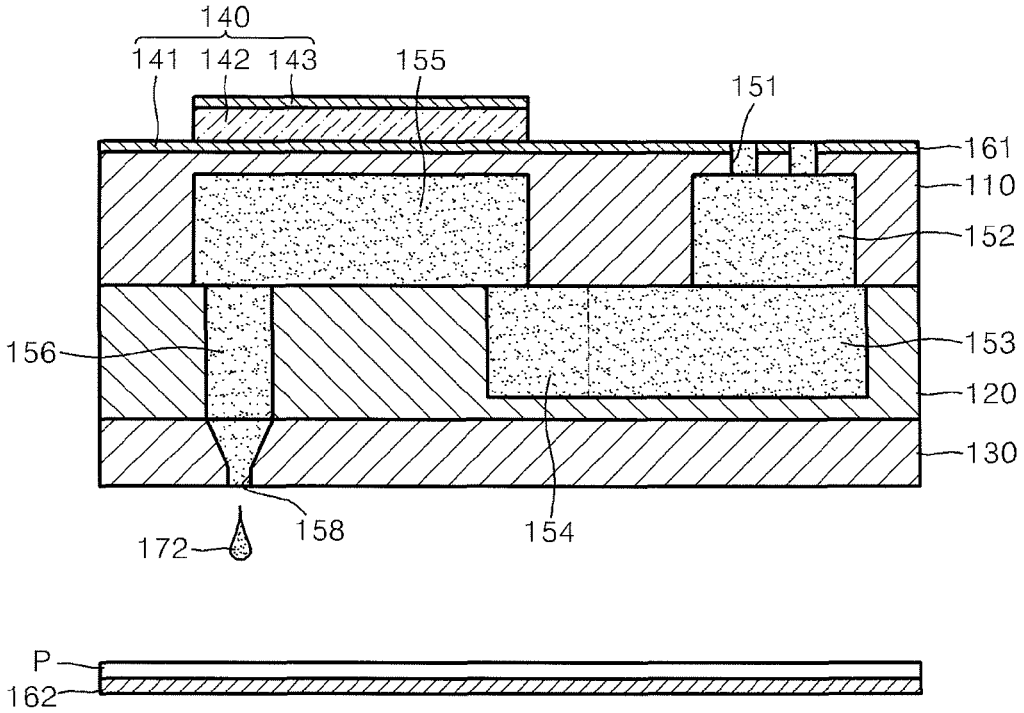
FIG. 4 is a cross-sectional view of a modified example of the inkjet printing device illustrated in FIG. 1 according to the embodiment of the present general inventive concept.

The first electrostatic electrode 161 is disposed on the top surface of the flow path plate over the ink inlet 152. Also, the second electrostatic electrode 162 is disposed a predetermined distance apart from a bottom surface of the flow path plate. Recording media P on which ink droplets ejected via the nozzle 158 of the flow path plate are printed are loaded and/or disposed on the second electrostatic electrode 162. In the above-described structure, when a predetermined voltage is applied to the first and second electrostatic electrodes 161 and 162, an electrostatic field is generated between the first and second electrostatic electrodes 161 and 162, and ink contained in the nozzle 158 moves toward the second electrostatic electrode 162 due to an electrostatic force caused by the electrostatic field. Meanwhile, although it is described above that the first electrostatic electrode 161 used to generate an electrostatic field is separate from the lower electrode 141 of the piezoelectric actuator 140, the present general inventive concept is not limited thereto. That is, as shown in FIG. 4, the first electrostatic electrode 161 may be integrally formed with the lower electrode 141.

In a conventional piezoelectric inkjet printing device, reducing an amount of deformation energy in a pressure chamber in order to produce ultrafine droplets having a size of several picoliters or less is necessary. In this case, however, the ejecting energy per volume of droplets is reduced and thus, the ejection rate of the droplets is also reduced. The reduction in the ejection rate of the droplets is problematic because the droplets cannot be exactly arrived in desired positions on recording media. Therefore, the present general inventive concept combines a piezoelectric inkjet printing device with an electrostatic inkjet printing device to produce ultrafine droplets. As a result the ultrafine droplets can be ejected at a predetermined speed or higher, so that the ultrafine droplets can be exactly printed in desired positions on recording media.

Hereinafter, a method of driving the inkjet printing device illustrated in FIG. 1 will be described according to embodiments of the present general inventive concept.

Figure 2A:
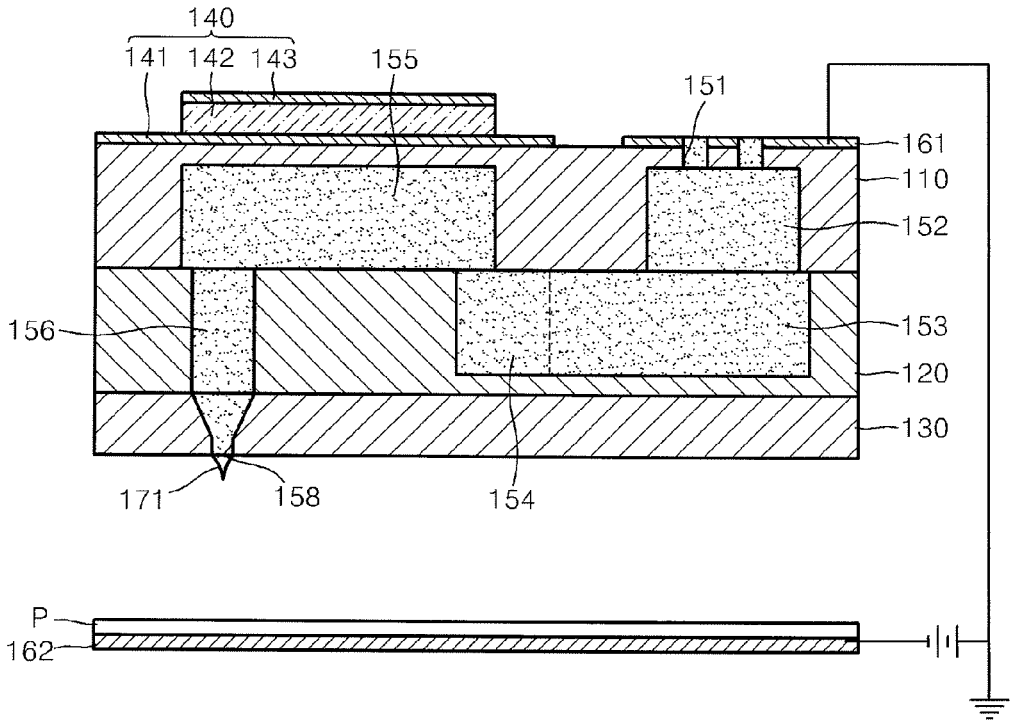
FIGS. 2A and 2B are diagrams illustrating a method of driving the inkjet printing device illustrated in FIG. 1, according to an embodiment of the present general inventive concept.
Figure 2B:
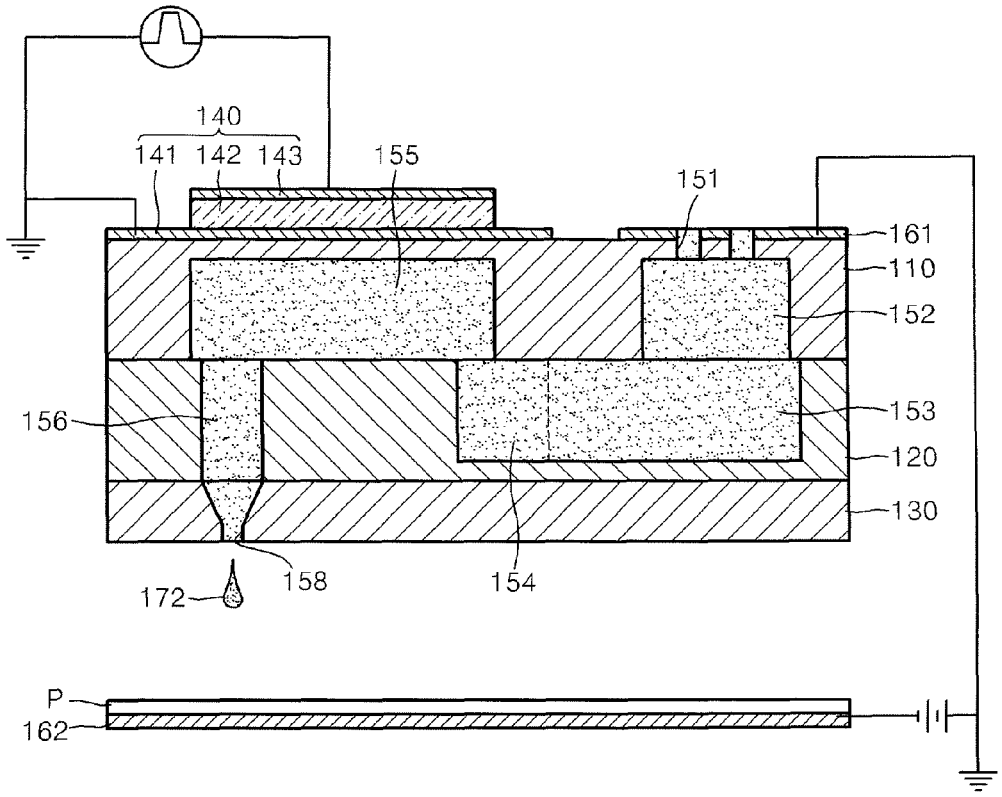

FIGS. 2A and 2B are diagrams illustrating a method of driving the inkjet printing device illustrated in FIG. 1, according to an embodiment of the present general inventive concept.

Referring to FIG. 2A, a predetermined bias voltage is applied between the first electrostatic electrode 161 and the second electrostatic electrode 162. Here, the bias voltage applied between the first and second electrostatic electrodes 161 and 162 only has to allow ink to protrude from the nozzle 158 without externally ejecting the ink from the nozzle 158. Thus, a predetermined electrostatic field is formed between the first and second electrostatic electrodes 161 and 162, so that a meniscus 171 of the ink protrudes from the nozzle 158 towards the second electrostatic electrode 162 due to an electrostatic force caused by the electrostatic field.

Referring to FIG. 2B, while the bias voltage is being applied between the first and second electrostatic electrodes 161 and 162, a predetermined piezoelectric driving pulse is applied between the lower and upper electrodes 141 and 143 to drive the piezoelectric actuator 140. When the piezoelectric driving pulse is applied between the lower and upper electrodes 141 and 143, the protruding meniscus 171 of the ink is ejected in a droplet 172, which reaches a desired position of the recording medium P.

According to the above-described method of driving the inkjet printing device according to one embodiment of the present general inventive concept, ink protrudes from the nozzle 158 using an electrostatic technique, and the protruding ink is ejected in the shape of the droplet 172 using a piezoelectric technique and is printed on the recording medium P. Accordingly, the inkjet printing device according to the present general inventive concept can embody the ultrafine droplet 172 with a size of several picoliters or less and exactly direct the ejected droplet 172 on a desired position of the recording medium P. Also, while the ink protrudes from the nozzle 158 by performing the electrostatic technique, the ink droplet 172 is ejected using the piezoelectric technique, so that the inkjet printing device can be driven at a lower voltage than a conventional piezoelectric inkjet printing device.

Figure 3A:
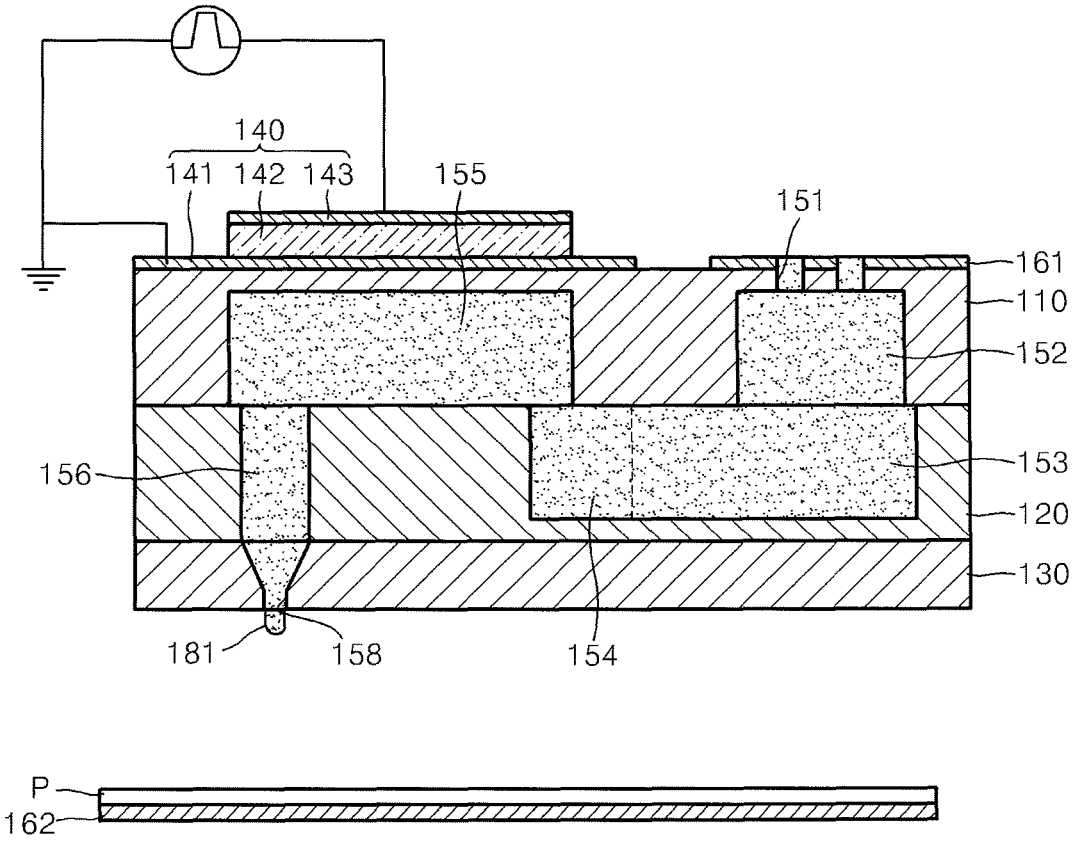
FIGS. 3A and 3B are diagrams illustrating a method of driving the inkjet printing device illustrated in FIG. 1, according to another embodiment of the present general inventive concept.
Figure 3B:
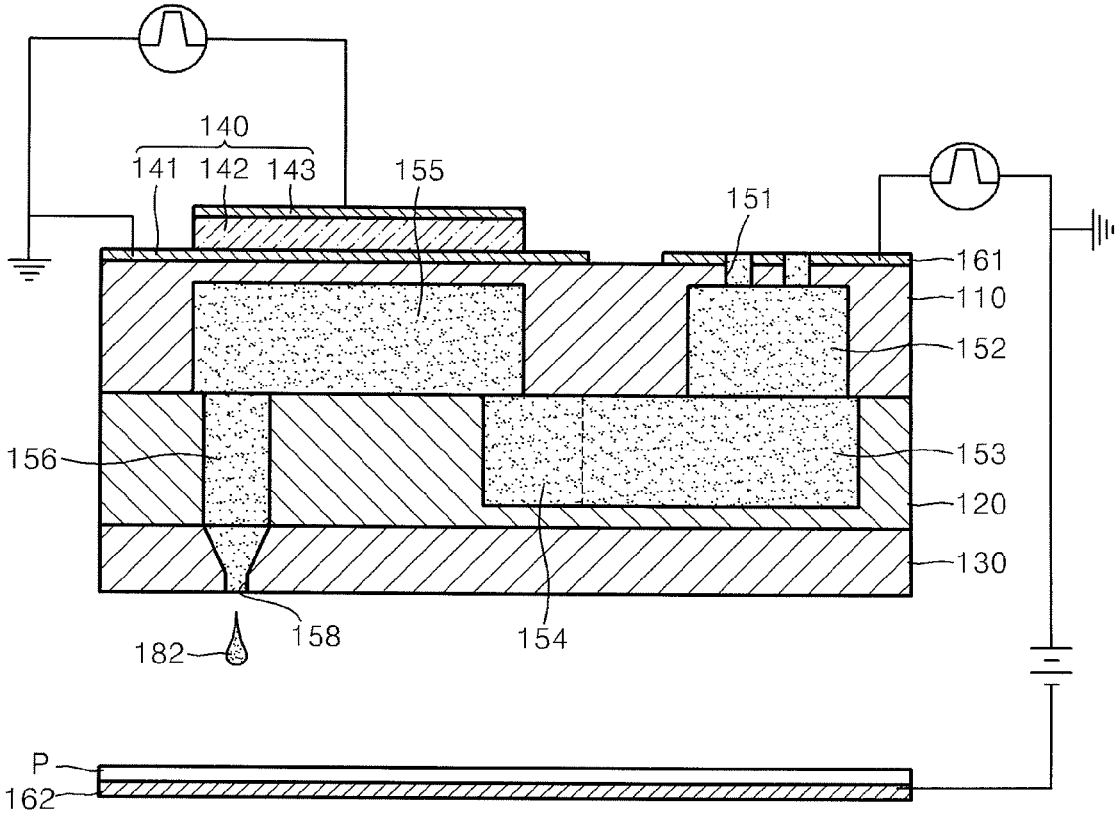

FIGS. 3A and 3B are diagrams illustrating a method of driving the inkjet printing device illustrated in FIG. 1, according to another embodiment of the present general inventive concept.

Referring to FIG. 3A, a predetermined piezoelectric driving pulse is applied between the lower and upper electrodes 141 and 143 to drive the piezoelectric actuator. Here, the piezoelectric driving pulse applied between the lower and upper electrodes 141 and a143 only has to allow the ink to protrude from the nozzle 158 without externally ejecting the ink from the nozzle 158. As a result, a meniscus 181 of the ink protrudes from the nozzle 158 towards the second electrostatic electrode 162.

Referring to FIG. 3B, while the piezoelectric driving pulse is being applied between the lower and upper electrodes 141 and 143, a predetermined electrostatic driving pulse is applied between the first and second electrostatic electrodes 161 and 162. Thus, a predetermined electrostatic field is formed between the first and second electrostatic electrodes 161 and 162. Due to an electrostatic force caused by the electrostatic field, the protruding meniscus 181 of the ink is ejected toward the second electrostatic electrode 162 in a droplet 182, which reaches a desired position of the recording medium P.

According to the above-described method of driving the inkjet printing device according to another embodiment of the present general inventive concept, ink protrudes from the nozzle 158 using a piezoelectric technique, and the protruding ink is ejected in a shape of the droplet 182 using an electrostatic technique and is printed on the recording medium P. Accordingly, the inkjet printing device according to the present general inventive concept can produce the ultrafine droplet 182 with a size of several picoliters or less and exactly print the ejected droplet 182 onto a desired position of the recording medium P. Also, since the piezoelectric driving pulse is only enough to protrude the ink from the nozzle 158, so that the inkjet printing device can be driven at a lower voltage than a conventional piezoelectric inkjet printing device.

Figure 5:
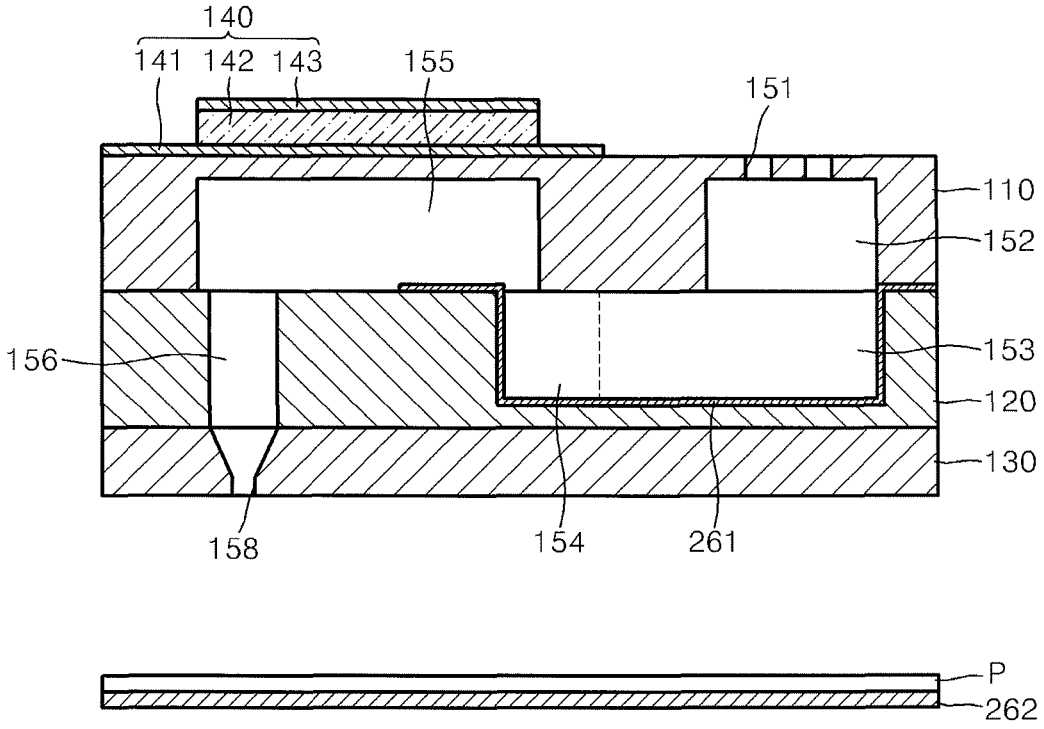
FIG. 5 is a cross-sectional view of an inkjet printing device according to another embodiment of the present general inventive concept.

FIG. 5 is a cross-sectional view of an inkjet printing device according to another embodiment of the present general inventive concept.

Referring to FIG. 5, the inkjet printing device according to another embodiment of the present general inventive concept includes a flow path plate including an ink flow path, a piezoelectric actuator 140, which is disposed on the flow path plate, and first and second electrostatic electrodes 261 and 262, which are spaced apart from each other to generate an electrostatic field therebetween.

The flow path plate may include first, second, and third substrates 110, 120, and 130 that are bonded to one another. The first substrate 110 may include a pressure chamber 155 that is filled with ink to be ejected. A portion of the first substrate 110, which forms a top wall of the pressure chamber 155, functions as a vibrating plate. Also, the first substrate 110 may further include an ink inlet 152 via which ink is externally supplied. The second substrate 120 may include a manifold 153 and a restrictor 154. In addition, the third substrate 130 may include a nozzle 158. The second substrate 120 may further include a damper 156 to connect the pressure chamber 155 and the nozzle 158. Although it is exemplarily described above that the flow path plate includes the three substrates 110, 120, and 130, the present general inventive concept is not limited thereto. For example, the flow path plate may include a first substrate (not illustrated), which includes a pressure chamber, and a second substrate (not illustrated), which includes a manifold, a restrictor, a damper, and a nozzle. Meanwhile, according to the present general inventive concept, the flow path plate may include four or more substrates. Also, an ink flow path formed in the flow path plate may be shaped in various ways. The piezoelectric actuator 140 is disposed on a top surface of the flow path plate disposed on the pressure chamber 155. The piezoelectric actuator 140 may include a lower electrode 141, a piezoelectric layer 142, and an upper electrode 143 that are stacked sequentially on the top surface of the flow path plate.

In the current embodiment, the first electrostatic electrode 261 used to generate an electrostatic field is disposed in the flow path plate. Specifically, the first electrostatic electrode 261 may be formed on bottom surfaces of the pressure chamber 155, the restrictor 154, and the manifold 153. However, the present general inventive concept is not limited thereto, and the first electrostatic electrode 261 may be provided in one of various positions in the flow path plate. For instance, the first electrostatic electrode 261 may be disposed on only one of the bottom surfaces of the pressure chamber 155, the restrictor 154, and the manifold 153.

The second electrostatic electrode 262 is disposed a predetermined distance apart from a bottom surface of the flow path plate. Recording media P on which ink droplets ejected via the nozzle 158 of the flow path plate are printed are loaded on the second electrostatic electrode 262. In the above-described structure, when a predetermined voltage is applied to the first and second electrostatic electrodes 261 and 262, an electrostatic field is generated between the first and second electrostatic electrodes 261 and 262, and ink contained in the nozzle 158 moves toward the second electrostatic electrode 262 due to an electrostatic force caused by the electrostatic field.

Figure 6:
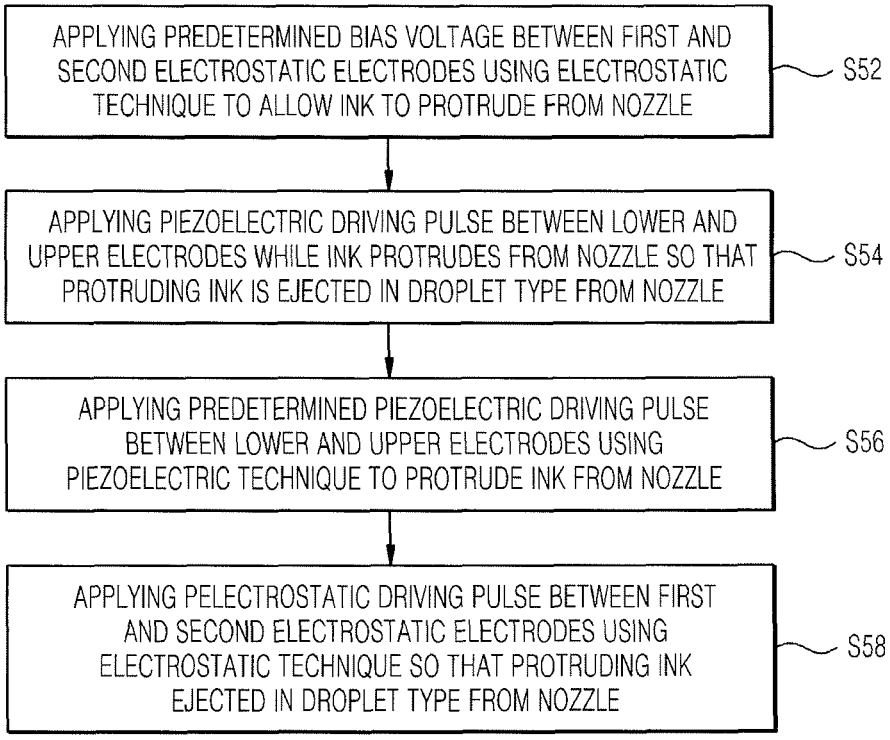
FIG. 6 is a flowchart illustrating a method of driving the inkjet printing device according to an embodiment of the present general inventive concept.

A method of driving the inkjet printing device illustrated in FIG. 5 is the same as the above-described method of driving the inkjet printing device illustrated in FIG. 1. Referring to FIGS. 5 and 6, in operation S52, a predetermined bias voltage is applied between the first and second electrostatic electrodes 261 and 262 using an electrostatic technique to allow the ink to protrude from the nozzle 158. While the ink protrudes from the nozzle 158, in operation S54, a piezoelectric driving pulse is applied between the lower and upper electrodes 141 and 143 so that the protruding ink is ejected in a droplet type from the nozzle 158. In operation S56, a predetermined piezoelectric driving pulse is applied between the lower and upper electrodes 141 and 143 using a piezoelectric technique to protrude ink from the nozzle 158. While the ink protrudes from the nozzle 158, in operation S58, an electrostatic driving pulse is applied between the first and second electrostatic electrodes 261 and 262 using an electrostatic technique so that the protruding ink is ejected in a droplet type from the nozzle. Since a detailed description of the two methods is presented above, it will be omitted here.

Figure 7:
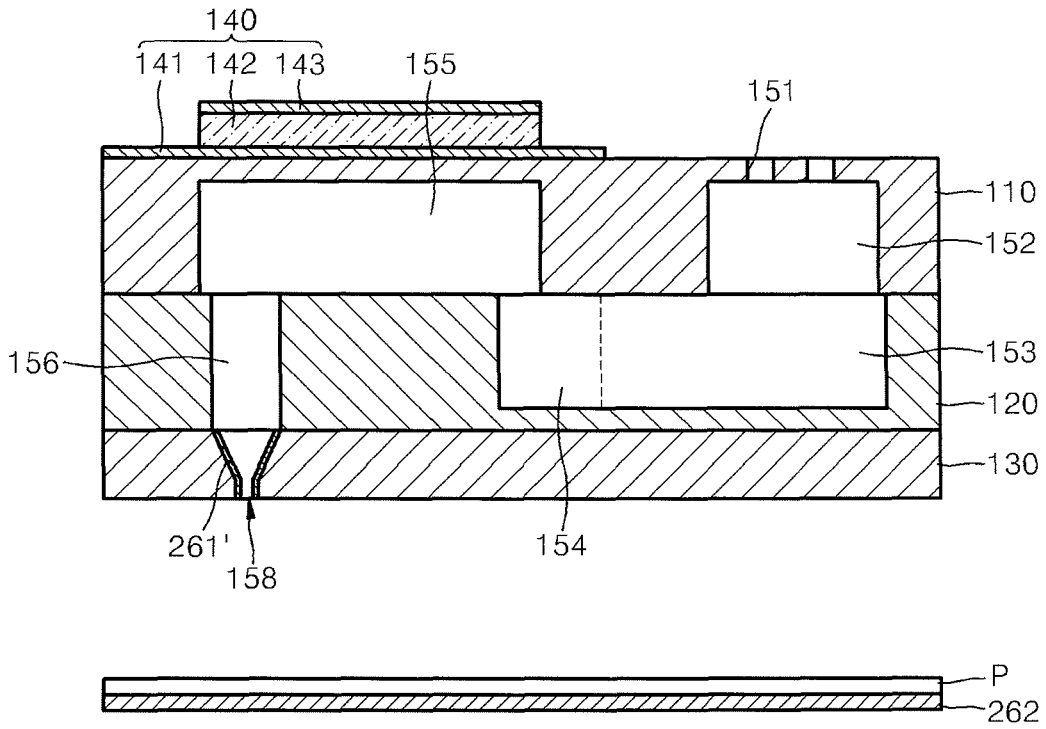
FIG. 7 is a cross-sectional view of a modified example of the inkjet printing device illustrated in FIG. 5 according to the embodiment of the present general inventive concept.

In the above description, although the first electrostatic electrode 261 is formed on the bottom surfaces of the pressure chamber 155, the restrictor 154, and the manifold 153, the present invention is not limited thereto. For example, as shown in FIG. 7, the first electrostatic electrode 261' may be formed on the inner wall of the nozzle 158.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

While the present general inventive concept has been particularly illustrated and described with reference to exemplary embodiments thereof, it will be understood by one of ordinary skill in the art that various changes in form and details may be made therein without departing from the spirit and scope of the present general inventive concept as defined by the following claims.

What is claimed is:

1. An inkjet printing device, comprising:

a flow path plate including a nozzle to eject ink, a pressure chamber to supply pressurized ink to the nozzle, and a manifold to supply ink to the pressure chamber, a restrictor to connect the manifold and the pressure chamber, and a damper to connect the pressure chamber and the nozzle;

a piezoelectric actuator to pressurize ink in the pressure chamber, the piezoelectric actuator having a lower electrode, a piezoelectric layer, and an upper electrode that are stacked sequentially on the flow path plate;

a first electrostatic electrode disposed on the flow path plate; and a second electrostatic electrode disposed apart from the flow path plate to generate an electrostatic field in conjunction with the first electrostatic electrode, wherein the first electrostatic electrode is integrally formed with the lower electrode of the piezoelectric actuator such that the first electrostatic electrode can act as both an electrostatic electrode and piezoelectric electrode.

2. The device of claim 1, wherein the flow path plate comprises:

a first substrate including the pressure chamber, on which the piezoelectric actuator is disposed;

a second substrate bonded to a bottom surface of the first substrate and including the manifold, the restrictor, and the damper; and a third substrate bonded to a bottom surface of the second substrate and including the nozzle.

3. The device of claim 2, wherein the first substrate further comprises:

an ink inlet via which the ink is supplied to the manifold.

4. The device of claim 2, wherein the first, second, and third substrates are formed of a material containing single crystalline silicon (Si).

5. The device of claim 1, wherein the flow path plate comprises:

a first substrate including the pressure chamber, on which the piezoelectric actuator is disposed; and a second substrate bonded to a bottom surface of the first substrate and including the manifold, the restrictor, the damper, and the nozzle.

6. An inkjet printing device, comprising:

a flow path plate comprising:

a lower substrate including a manifold, a restrictor, a damper and a nozzle; and an upper substrate disposed on a first side of the lower substrate and including an ink inlet to supply ink to the manifold and a pressure chamber to receive ink from the manifold and supply ink to the nozzle, the manifold and the pressure chamber connected to each other by the restrictor, the pressure chamber and the nozzle are connected to each other by the damper;

a piezoelectric actuator disposed on the pressure chamber to pressurize the pressure chamber the piezoelectric actuator having a lower electrode, a piezoelectric layer, and an upper electrode that are stacked sequentially on the flow path plate;

a first electrostatic electrode disposed on the flow path plate; and a second electrostatic electrode spaced apart from the flow path plate to generate an electric field in conjunction with the first electrode, wherein the first electrostatic electrode is integrally formed with the lower electrode of the piezoelectric actuator such that the first electrostatic electrode can act as both an electrostatic electrode and a piezoelectric electrode.

7. The inkjet printing device of claim 6, wherein the lower substrate comprises:

a bottom substrate comprising the nozzle; and a middle substrate disposed between the bottom substrate and the upper substrate, the middle substrate comprising the manifold, the restrictor, and a damper to supply ink from the pressure chamber to the nozzle.

* * * * *